US007886913B1

(12) United States Patent
Fritz et al.

(10) Patent No.: US 7,886,913 B1
(45) Date of Patent: Feb. 15, 2011

(54) PROCESS, METHOD AND SYSTEM FOR RECOVERING WEAKLY MAGNETIC PARTICLES

(75) Inventors: Alan J. Fritz, Grand Rapids, MN (US); Eugene R. Bergstrom, Deer River, MN (US); Edward J. Shaughnessy, Bovey, MN (US)

(73) Assignee: Magnetation, Inc., Nashwauk, MN (US)

( * ) Notice: Subject to any disclaimer, the term of this patent is extended or adjusted under 35 U.S.C. 154(b) by 0 days.

(21) Appl. No.: 12/384,830

(22) Filed: Apr. 9, 2009

Related U.S. Application Data

(60) Provisional application No. 61/123,704, filed on Apr. 9, 2008.

(51) Int. Cl.
*B03C 1/00* (2006.01)

(52) U.S. Cl. ..... 209/224; 209/39; 209/214; 209/223.1; 209/225; 209/232

(58) Field of Classification Search ..... 209/8, 209/38, 39, 213, 214, 223.1, 224, 225, 228, 209/232; 210/222, 223, 695
See application file for complete search history.

(56) References Cited

U.S. PATENT DOCUMENTS

| | | | | | |
|---|---|---|---|---|---|
| 3,326,374 | A | * | 6/1967 | Jones | 209/214 |
| 3,375,925 | A | * | 4/1968 | Carpenter | 209/214 |
| 3,690,454 | A | * | 9/1972 | Bekhtle et al. | 209/38 |
| 3,873,448 | A | * | 3/1975 | Isberg et al. | 210/222 |
| 3,947,349 | A | | 3/1976 | Fritz | |
| 4,046,680 | A | | 9/1977 | Fritz | |
| 4,059,510 | A | * | 11/1977 | Reading | 209/223.2 |
| 4,191,591 | A | * | 3/1980 | Bender et al. | 134/25.1 |
| 4,726,895 | A | * | 2/1988 | Martinez | 209/2 |
| 4,737,294 | A | * | 4/1988 | Kukuck | 210/695 |
| 4,874,508 | A | | 10/1989 | Fritz | |
| 5,205,414 | A | * | 4/1993 | Martinez | 209/8 |
| 5,462,173 | A | * | 10/1995 | Darling | 209/39 |
| 5,961,055 | A | | 10/1999 | Lehtinen | |

* cited by examiner

*Primary Examiner*—Joseph C Rodriguez
(74) *Attorney, Agent, or Firm*—Krieg DeVault LLP

(57) ABSTRACT

Methods to separate certain valuable elements and/or minerals that utilize wet screens, hydro-cyclones, low intensity magnetic separators and/or Mag Wheel™ separators, including a specially designed magnetic field amplifying matrix. The methods are applicable to mining, manufacturing, mineral processing, or other treatment processes or systems.

21 Claims, 4 Drawing Sheets

PROCESS, METHOD AND SYSTEM FOR RECOVERING WEAKLY MAGNETIC PARTICLES

RELATED APPLICATIONS

The present application claims the benefit of U.S. provisional patent application No. 61/123,704 filed on Apr. 9, 2008, which is hereby incorporated by reference in its entirety.

BACKGROUND

The explosion of demand for commodities as a result of the industrial revolution occurring in China and to a lesser extent in India and other developing countries has lead to a search of the globe for all occurrences of economic concentrations of a wide variety of minerals and elements including but not limited to iron oxides, gold, copper, platinum, palladium, nickel, silver, titanium, manganese, and magnesium. Occurrences of such elements and minerals, which can occur naturally or as a result of prior mining or mineral processing operations, can become economically recoverable if low cost mineral processing systems, such as those based upon magnetic properties of minerals, are developed that can concentrate such mineral assemblages or elemental concentrations with respect to the element of interest. The recovery of weakly magnetic or para-magnetic particles from assemblages of non-magnetic, strongly magnetic, and weakly or para-magnetic particles would make many mineral and elemental occurrences around the planet economically feasible but such mineral processing systems, processes or methods have been unavailable, unknown, or prohibitively expensive to build and operate to date with existing systems, methods, and processes in the prior art. Of particular economic interest are mineral concentrations of certain elements like iron and precious metals (gold, platinum, and palladium) that occur naturally in certain rock and mineral formations around the planet and iron and precious metals concentrations existing as a result of the creation of reject tailings deposition basins or lean ore stockpiles resulting from past mining and mineral processing operations. These tailings basins and stockpiles represent a collection of elements in demand in a form that already has considerable energy, manpower and "carbon footprint" invested into the mining and size reduction of the rock involved and therefore such occurrences have even greater economic and environmental attraction in the ongoing commodity shortage and concerns regarding climate change.

SUMMARY

There are provided methods, processes and systems that separate non-magnetic particles and strongly magnetic particles from weakly magnetic particles where all three types of particles are assembled and transported in a fluid-mineral suspension where the fluid is liquid water. Such mineral-water mixture is hereafter referred to as "slurry". There are also provided methods, processes and systems to separate binary mineral systems where only weakly magnetic particles and non-magnetic particles are present. As used herein, the term "magnetic," when referring to a particle or mineral, is used interchangeably with the term "magnetic susceptibility," and refers to the property of being influenced by a magnetic field.

In various embodiments, there are provided processes that include some or all of the following unit processes: dredging, pumping, wet screening, low intensity magnetic separation, high intensity magnetic separation, hydro-cycloning, spiral classification and conveyance of product to a stockpile for further dewatering and pumping of tailings reject material to disposal cells or basins. Additional components that can be used to practice methods and processes described herein include, for example, vibratory dewatering screens, filters, driers, deslimers, dredges, pumps, pipelines, sumps, slurry tanks, and conveyors.

In one aspect, the present application provides a method for treating a mineral assemblage including non-magnetic particles and weakly magnetic particles that includes: (1) providing a slurry including the mineral assemblage suspended in water; (2) passing the slurry through a plurality of treatment phases; and (3) modifying the solid to liquid ratio of the slurry by adding water to the slurry or removing water from the slurry before, during or after at least one of the treatment phases. The plurality of treatment phases includes at least one particle size separation phase and at least two high intensity magnetic separation phases.

In another aspect, the present application provides a method for separating a mineral assemblage slurry into a magnetic particle fraction and a non-magnetic particle fraction that includes: (1) providing a high intensity magnetic separation device comprising a drum-shaped set of connected and spaced apart hollow rings rotating around a common horizontal axis, each hollow ring defining openings through inner and outer surfaces thereof and containing a matrix material therein, whereby the set of rings is configured to allow passage of a plurality of separate inwardly moving fluid streams through the outer openings into the hollow rings, in contact with the matrix material contained in the rings, and through the inner openings, and to allow passage of an outwardly moving fluid stream through the inner openings, the matrix material, and the outer openings; the device further comprising a first set of permanent magnets positioned to apply a first magnetic field across the rings at a first position in an upper quadrant of the rings where the rotation of the rings approaches the top-most point of rotation, and a second set of permanent magnets positioned to apply a second magnetic field across the rings at a second position in the lower quadrant of the rings where the rotation of the rings approaches the bottom-most point of rotation; (2) feeding the slurry to an outer surface of the set of rings, and into the rings through the outer openings, at a to position where the matrix is positioned in the first magnetic field; (3) passing a first non-magnetic particle fraction through the matrix while the matrix is in the first magnetic field and into a first non-magnetic flowpath; (4) flushing magnetic particles that adhere to the matrix in the first magnetic field with water after the matrix rotates out of the first magnetic field, to pass the magnetic particles into a first magnetic flowpath separate and distinct from the first non-magnetic flowpath to provide a first magnetic particle fraction; (5) feeding the first non-magnetic particle fraction to an inner surface of the set of rings, and into the rings through the inner openings, at a position where the matrix is positioned in the second magnetic field; (6) passing a second non-magnetic particle fraction through the matrix while the matrix is in the second magnetic field and into a second non-magnetic flowpath; and (7) flushing magnetic particles that adhere to the matrix in the second magnetic field with water after the matrix rotates out of the second magnetic field, to pass the magnetic particles into a second magnetic flowpath separate and distinct from the second non-magnetic flowpath to provide a second magnetic particle fraction. At least one of the hollow rings is divided into a plurality of arc-shaped compartments and each of the plurality of compartments contains a plurality of discreet magnetically susceptible objects.

In another aspect, the present application provides a method for separating a mineral assemblage slurry into a magnetic particle fraction and a non-magnetic particle fraction that includes: (1) providing a high intensity magnetic separation device comprising a drum-shaped set of connected and spaced apart hollow rings rotating around a common horizontal axis, each hollow ring defining openings through inner and outer surfaces thereof and containing a matrix material therein, whereby the set of rings is configured to allow passage of a plurality of separate inwardly moving fluid streams through the outer openings into the hollow rings, in contact with the matrix material contained in the rings, and through the inner openings, and to allow passage of an outwardly moving fluid stream through the inner openings, the matrix material, and the outer openings; the device further comprising a first set of permanent magnets positioned to apply a first magnetic field across the rings at a first position in an upper quadrant of the rings where the rotation of the rings approaches the top-most point of rotation, and a second set of permanent magnets positioned to apply a second magnetic field across the rings at a second position in the lower quadrant of the rings where the rotation of the rings approaches the bottom-most point of rotation; (2) mixing magnetite particles into the mineral assemblage slurry to provide a feed mixture; (3) feeding the feed mixture to an outer surface of the set of rings, and into the rings through the outer openings, at a position where the matrix is positioned in the first magnetic field; (4) passing a first non-magnetic particle fraction through the matrix while the matrix is in the first magnetic field and into a first non-magnetic flowpath; (5) flushing magnetic particles that adhere to the matrix in the first magnetic field with water after the matrix rotates out of the first magnetic field, to pass the magnetic particles into a first magnetic flowpath separate and distinct from the first non-magnetic flowpath to provide a first magnetic particle fraction; (6) feeding the first non-magnetic particle fraction to an inner surface of the set of rings, and into the rings through the inner openings, at a position where the matrix is positioned in the second magnetic field; (7) passing a second non-magnetic particle fraction through the matrix while the matrix is in the second magnetic field and into a second non-magnetic flowpath; and (8) flushing magnetic particles that adhere to the matrix in the second magnetic field with water after the matrix rotates out of the second magnetic field, to pass the magnetic particles into a second magnetic flowpath separate and distinct from the second non-magnetic flowpath to provide a second magnetic particle fraction.

In yet another aspect, the present application provides a high intensity magnetic separation device for separating a mineral assemblage slurry into fractions that includes a drum-shaped set of connected and spaced apart hollow rings rotating around a common horizontal axis, each hollow ring defining openings through inner and outer surfaces thereof and containing a matrix material therein, whereby the set of rings is configured to allow passage of an inwardly moving fluid stream through the outer openings, the matrix material, and the inner openings, and to allow passage of an outwardly moving fluid stream through the inner openings, the matrix material, and the outer openings; the device further comprising a first set of permanent magnets positioned to apply a first magnetic field across the rings at a first position in an upper quadrant of the rings where the rotation of the rings approaches the top-most point of rotation, and a second set of permanent magnets positioned to apply a second magnetic field across the rings at a second position in the lower quadrant of the rings where the rotation of the rings approaches the bottom-most point of rotation; at least one feed conduit for delivering the slurry into the hollow rings within the first magnetic field; and at least two flowpaths at least partially positioned within the drum-shaped set of hollow rings for receiving separated fractions of the slurry after it passes through the rings. At least one of the hollow rings is divided into a plurality of arc-shaped compartments and each of the plurality of compartments contains a plurality of discreet magnetically susceptible objects.

In still another aspect, the present application provides a method for separating gold particles from a mineral assemblage slurry that includes: (1) providing a high intensity magnetic separation device comprising a drum-shaped set of connected and spaced apart hollow rings rotating around a common horizontal axis, each hollow ring defining openings through inner and outer surfaces thereof and containing a matrix material therein, whereby the set of rings is configured to allow passage of a plurality of separate inwardly moving fluid streams through the outer openings into the hollow rings, in contact with the matrix material contained in the rings, and through the inner openings, and to allow passage of an outwardly moving fluid stream through the inner openings, the matrix material, and the outer openings; the device further comprising a first set of permanent magnets positioned to apply a first magnetic field across the rings at a first position in an upper quadrant of the rings where the rotation of the rings approaches the top-most point of rotation, and a second set of permanent magnets positioned to apply a second magnetic field across the rings at a second position in the lower quadrant of the rings where the rotation of the rings approaches the bottom-most point of rotation; (2) feeding the slurry including gold particles to an outer surface of the set of rings, and into the rings through the outer openings, at a position where the matrix is positioned in the first magnetic field; (3) passing a first non-magnetic particle fraction through the matrix while the matrix is in the first magnetic field and into a first non-magnetic flowpath; (4) flushing magnetic particles that adhere to the matrix in the first magnetic field with water after the matrix rotates out of the first magnetic field to a first magnetic flowpath separate and distinct from the first non-magnetic flowpath to provide a first magnetic particle fraction; (5) feeding the first non-magnetic particle fraction to an inner surface of the set of rings, and into the rings through the inner openings, at a position where the matrix is positioned in the second magnetic field; (6) passing a second non-magnetic particle fraction through the matrix while the matrix is in the second magnetic field and into a second non-magnetic flowpath; and (7) flushing magnetic particles that adhere to the matrix in the second magnetic field with water after the matrix rotates out of the second magnetic field, to pass the magnetic particles into a second magnetic flowpath separate and distinct from the second non-magnetic flowpath to provide a second magnetic particle fraction. One or both of the first magnetic particle fraction and the second magnetic particle fraction includes a concentrated fraction of the gold particles originally present in the mineral assemblage slurry.

These and other aspects of the inventive methods, systems and processes are discussed further below.

DETAILED DESCRIPTION

Figure 1:
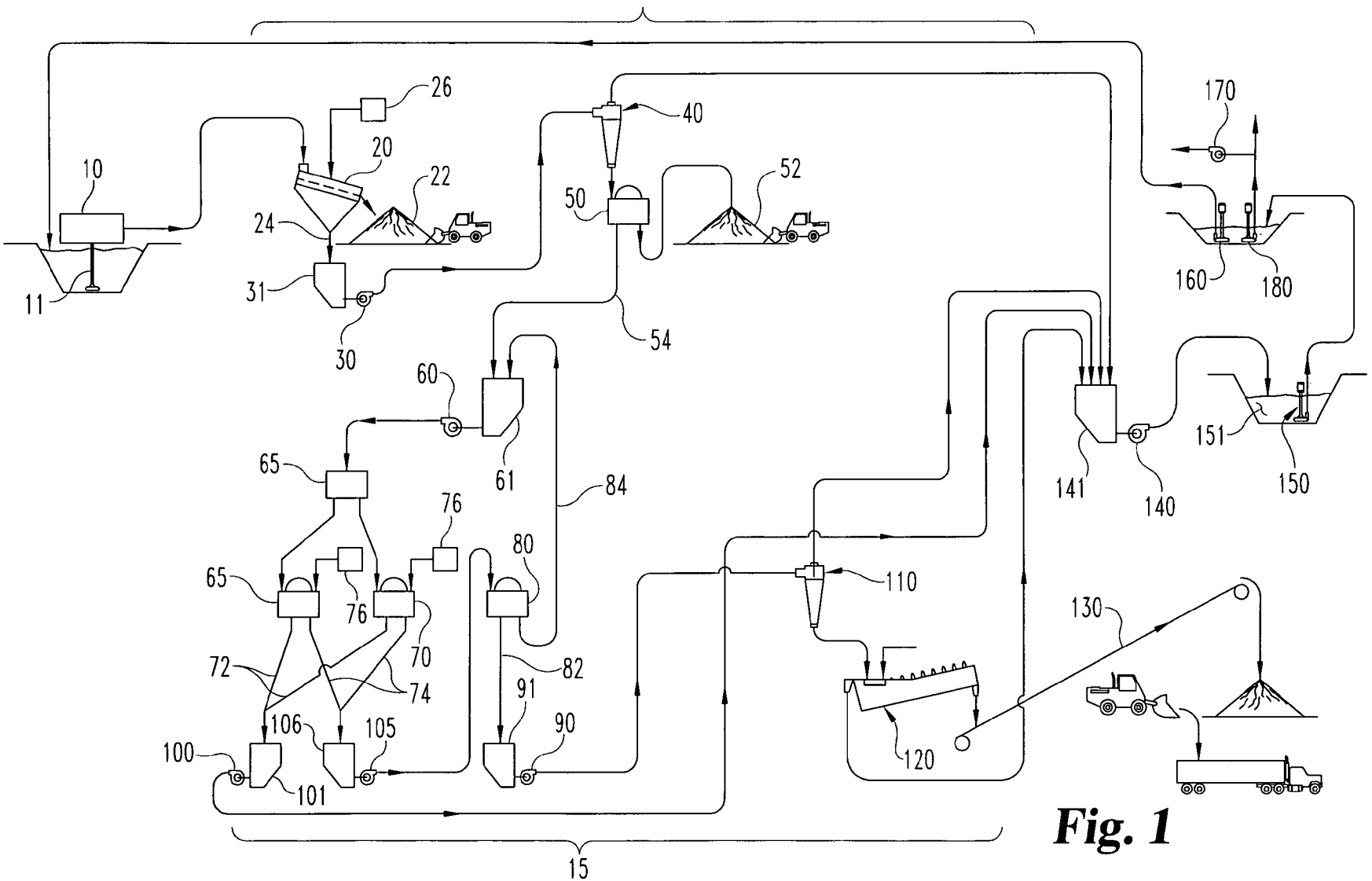
FIG. 1 is a flow diagram of one embodiment of the application including hydraulic mining, pumping, wet screening, hydro-cycloning, slurry storage, desliming, secondary screening, low intensity magnetic separation, two stages of high intensity separation, hydro-cycloning, spiral classifying, stockpiling/de-watering and shipment.

For the purposes of promoting an understanding of the principles of the invention, reference will now be made to the embodiments illustrated in the figures and specific language will be used to describe the same. It will nevertheless be understood that no limitation of the scope of the invention is thereby intended. Any such alterations and further modifications in the described devices, systems, processes and methods, and such further applications of the principles of the invention as described herein are contemplated as would normally occur to one skilled in the art to which the present application relates.

The present application provides methods, processes, devices and systems to treat certain mineral assemblages in such a fashion as to separate certain valuable elements and/or minerals from less valuable minerals or elements. The methods and processes described herein employ a sequence and combination of mineral processing unit operations including, but not limited to, some or all of the following: wet screens, hydro-cyclones, high intensity magnetic separators, low intensity magnetic separators, low intensity cleaner magnetic separators, wet fine screening, hydro-cyclones, spiral classifiers, vibratory dewatering screens, dredges, pumps, pipelines, sumps, slurry tanks, and conveyors. In one aspect of the application, a process for treating a mineral assemblage comprises providing a slurry including the mineral assemblage and water; passing the slurry through a plurality of treatment phases (also referred to herein as "stages"); and modifying the solid to liquid ratio of the slurry by adding water to the slurry or removing water from the slurry (also referred to herein as "dewatering") before, during or after at least one of the treatment phases; wherein the plurality of treatment phases includes at least one particle size separation phase and at least two high intensity magnetic separation phases. Additional unit processes and variations in process parameters are contemplated in various embodiments, examples of which are discussed further below, and a given process can be tailored in accordance with the present disclosure to optimize separation of mineral assemblages of different composition. For example, modification of the process to incorporate additional size screening steps, dewatering steps and the like, or to recycle various flow streams to pass a concentrate fraction through a magnetic separator one or more additional times, are modifications contemplated by the present application to improve separation results where appropriate, for example, to account for varying particle size characteristics of the slurry, mineral content of the particles and the like.

Other aspects of the present application, described further hereinbelow, relate to a novel high intensity magnetic separator referred to herein as the MagWheel™ separator, various embodiments of which include certain novel features and attributes, including, for example, an embodiment featuring a unique orientation of flow paths and an embodiment including a unique magnetic field amplifying matrix.

The term "mineral assemblages" is used herein to refer to particle mixtures that include both magnetic and nonmagnetic particles, examples of which include particle mixtures that result from mining, manufacturing, mineral processing, or other treatment processes or systems. One mineral assemblage specifically contemplated by the present application is a particle mixture that results from iron mining operations, such as, for example, discarded solid material that includes ore of relatively low grade and/or material that includes a significant proportion of non-ferrous rock material. The mineral assemblages can also be mineral assemblages that are extracted for treatment from their natural state in rock formations or alluvial mineral collections. The present application also contemplates that certain mineral assemblages may include large rocks or other solid portions that include target minerals, which would benefit from size reduction processing to extract target minerals therefrom. Thus, the application contemplates passing such materials through a crusher or grinder device, or other suitable size reduction device, prior to formation of a mineral assemblage slurry for treatment as described herein. The mineral assemblages to be treated may include, for example, iron oxide or gold tailings from taconite processing or gold recovery operations; iron oxide or gold tailings from natural iron ore or gold wash, density separation, sluicing plants, or heavy media processing plants; iron oxide or gold mineralization stockpiles containing concentrations of gold, silica, magnetite and/or hematite and possibly other minor minerals; iron formations including concentrations of hematite, magnetite, silica and possibly other minor minerals or alluvial concentrations of aggregates containing free gold or gold processing plant tailing materials.

The methods, processes, devices and systems described herein are useful for separating non-magnetic particles and strongly magnetic particles from weakly magnetic particles where all three types of particles are present in a mineral assemblage, and are also useful for separating weakly magnetic particles from non-magnetic particles where the mineral assemblage is a binary mineral system in which only weakly magnetic particles and non-magnetic particles are present.

In a process for separation of a mineral assemblage in accordance with the present application, the mineral assemblage to be separated is provided as a slurry. The term "slurry" is used herein to refer to a fluid-mineral suspension of the mineral assemblage in which the mineral particles are suspended in liquid water. A mineral assemblage can be provided as a slurry by mixing the mineral assemblage with water either during or subsequent to mining excavation of the mineral assemblage. After a slurry is provided, it is treated by a sequence of mineral processing steps or unit processes to separate the minerals or elements sought (referred to herein as "concentrates" or "concentrate fractions" or "magnetic fractions") from the waste or reject minerals (referred to herein as "tailings" or "tailings fractions"). Specifically, the slurry is passed through a plurality of treatment steps, and the solid to liquid ratio of the slurry is modified by adding water to the slurry or by removing water from the slurry before, during or after at least one of the treatment phases. The plurality of treatment phases includes at least one size separation phase and at least two high intensity magnetic separation phases. In one embodiment, the slurry is first passed through a wet screening device to remove relatively large particles and debris from the mineral assemblage, and then the slurry is passed through two high intensity magnetic separation phases to separate the mineral assemblage into one or more magnetic fraction and one or more non-magnetic fraction. In alternate embodiments, the method includes one or more of the following unit processes: dredging, pumping, low intensity magnetic separation, hydro-cycloning, spiral classification and conveyance of product to a stockpile for further dewatering and pumping of tailings reject material to one or more disposal cells or basins. As will be appreciated by a person of ordinary skill in the art, hydro-cycloning and spiral classification processes can be utilized to modify the solid to liquid ratio of the slurry by removing excess water from the slurry. In addition, the solid to liquid ratio of the slurry can be modified by adding water to the slurry during dredging, pumping, wet screening and magnetic separation processes.

With reference to FIG. 1, the process embodiment depicted schematically therein is particularly useful for processing a mineral assemblage comprising magnetite, hematite and non-magnetic particles, such as the natural ore tailings produced over the last 100 years of mining operations on the Mesabi Iron Range of Minnesota. In this process, dredge 10 is used to perform hydraulic mining/excavation of a mineral waste product (also referred to as a mineral assemblage), such as the tailings waste product left behind in a storage basin by prior mining and processing of naturally concentrated iron ore or "natural ore." Dredge 10 is equipped with an auger/cutter 11 and pump (not shown) to excavate the tailings and suspend the tailings particles in water to provide a slurry. A variety of dredge devices are available commercially, and it is well within the purview of a skilled artisan to select, obtain and use a suitable dredge in the methods described herein. The slurry is transported from to dredge 10 by slurry pumps (not shown) to a portable mineral processing plant 15 for further treatment as described further below. In other embodiments, the process can be performed in a permanent processing plant.

The tailings slurry is passed through wet screening device 20 to remove oversize debris and organic matter such as roots, tree branches, leaves and vegetation to waste pile 22, or optionally to a receptacle of some type (not shown). Wet screening devices are known in the art and are available commercially, and it is well within the purview of a skilled artisan to select, obtain and use a suitable wet screening device in the methods described herein. If desired, additional water can be poured or sprayed onto wet screening device 20 from optional water source 26. The rejected organic matter in waste pile 22 can be usefully saved for subsequent reclamation of the mining areas from which the tailings are excavated, if desired. The cleaned tailings slurry 24, free of organic debris, rocks, pebbles and other inorganic debris, is collected in sump 31 and then transported by pump 30 through pipes (not shown), or optionally by gravity flow through launders in other embodiments, to hydraulic cycloning device 40 (also referred to herein as hydro-cycloning device 40), which operates to remove excess transport water and to control the ratio of solids to water in the slurry to be processed. Hydro-cloning devices are known in the art and are available commercially, and it is well within the purview of a skilled artisan to select, obtain and use a suitable hydro-cloning device in the methods described herein. Water removed from the slurry in hydro-cycloning device 40 can optionally be transported by pumping or gravity flow to main tailings sump 141, which is discussed further below. The slurry having a higher solids to water ratio is then subjected to low intensity magnetic separation in magnetic separator 50 to remove strongly magnetic particles such as magnetite, martite, and/or mag-hemite, which are collected in mag pile 52, or optionally in a receptacle of some type (not shown). A wide variety of low intensity magnetic separation devices are known and commercially available, and it is well within the purview of a skilled artisan to select, obtain and use a suitable low intensity magnetic separation device in the methods described herein.

The treated tailings slurry 54, free of strongly magnetic particles, is collected in treated tailings sump 61 and then transported by pump 60 through pipes (not shown), or optionally by gravity flow through launders in other embodiments, to pressure distributor 65, and then to rougher/scavenger wheel high intensity magnetic separation devices 70, which operate to separate the non-magnetic materials, such as, for example, the mineral silica ($SiO_2$) from the weakly magnetic materials in the slurry, such as, for example, the iron mineral, hematite, which includes iron having the ferric valence (+3). Devices 70 employ permanent magnets and magnetic field amplifying matrix materials designed to optimize iron recovery and grade of the product generated. Passage of treated tailings slurry 54 through high intensity magnetic separation devices 70 is referred to herein as "stage one" magnetic separation. The schematic diagram set forth in FIG. 1 depicts two separation devices 70 in this embodiment; however, it is to be understood that in alternate embodiments contemplated by the present application one device 70, or three more devices 70, can be employed if desired. In one embodiment, at least one of devices 70 is of a type described in U.S. Pat. No. 4,046,680 to Fritz or U.S. Pat. No. 4,874,508 to Fritz, each of which is incorporated by reference herein in its entirety. In another embodiment, at least one of devices 70 is a MagWheel™ magnetic separator (MagWheel™ is a trademark of Magnetation, Inc.), examples of which are described herein below. Certain embodiments of the MagWheel™ device include features designed to minimize plugging of the separator during use, which is a common problem encountered in the use of wet high intensity magnetic separators employing magnetic field amplifying matrix materials used to separate materials in slurry form. If desired, additional water can be poured or sprayed into devices 70 from optional water sources 76.

Passage of treated tailings slurry 54 through separation devices 70 separates slurry 54 into two fractions, referred to herein as rougher concentrate fraction 74 and rougher tailings fraction 72. The rougher tailings fraction 72 is collected in rougher tailings sump 101 and then transported by pump 100 through pipes (not shown), or optionally by gravity flow through launders in other embodiments, to main tailings sump 141, which is discussed further below. The rougher concentrate fraction 74 is collected in rougher concentrate sump 106 and then transported by pump 105 through pipes (not shown), or optionally by gravity flow through launders in other embodiments, to cleaner wheel high intensity magnetic separation device 80, which operate to further separate particles that are composed of both silica and hematite, referred to herein as "middlings", from particles composed largely of hematite. Cleaner wheel 80 employs permanent magnets and magnetic field amplifying matrix materials designed to optimize iron recovery and grade of the product generated. Moreover, cleaner wheel 80 can be of the same type and design as separation devices 70, or can be unique. In one preferred embodiment, cleaner wheel 80 is a MagWheel™ device as described further hereinbelow. Passage of rougher concentrate fraction 74 through high intensity magnetic cleaner wheel 80 is referred to herein as "stage two" magnetic separation, and separates rougher concentrate fraction 74 into a cleaner concentrate fraction 82 and a cleaner tailings fraction 84. Because the rougher concentrate fraction 74 entering cleaner wheel 80 is of relatively high magnetic content, even the cleaner tailings fraction 84 includes a relatively high concentration of magnetic material. Thus, the cleaner tailings fraction 84 from the stage two cleaner wheel separator 80, being of too high an iron concentration to reject, is recycled to and combined with the new feed material going to the stage one high intensity magnetic separation devices 70, thereby forming a circulating load to optimize product recovery and grade. In the embodiment depicted in FIG. 1, this is achieved by transporting cleaner tailings fraction 84 from cleaner wheel 80 to treated tails sump 61.

Cleaner concentrate fraction 82 is collected in cleaner concentrate sump 91 and then transported by pump 90 through pipes (not shown), or optionally by gravity flow through launders in other embodiments, to subsequent process steps to further increase the concentration of iron in the end product. In the embodiment depicted in FIG. 1, the iron concentration in cleaner concentrate fraction 82 is further increased by treatment through two dewatering/desliming steps using hydro-cyclone 110 and spiral classifier 120.

The slurry from the hydro-cyclones comprises a lower ratio of water to solids and will also contain less ultra-fine particles (i.e., particles smaller than 44 microns, also known in the mineral processing industry as "slimes"). The slurry from the hydro-cyclones preferably can flow by gravity directly to the spiral classifier avoiding a pumping step. The spiral classifier washes the product to remove slimes and further increases the ratio of solids to water in the iron concentrate product. The output of the spiral classifier, the iron concentrate, is a solid mineral product highly concentrated with respect to iron that can be transported by conveyor 130 and stockpiled for optional additional de-watering, for example, by both gravity drainage of entrained water and air drying by evaporation prior to shipment to customers. Alternatively, the wet iron concentrate produced by the spiral classifier can be dried using a drier (not shown) that causes additional evaporation or vaporization of the water within the iron concentrate by exposing it to electrical radiant energy or air heated by combustion of fossil fuels or air heated by electricity. Alternatively, the product can be dried using microwave driers. A dry iron concentrate product can then be bagged for sale or transport, or can alternatively be sold or otherwise transported in bulk. The iron concentrate can be used in a variety of commercially useful ways, such as, for example, as an iron source in a nugget plant, as a concrete or drilling weighting agent or as a coloring agent, such as, for example, as a pigment for asphalt or glass manufacturing.

As stated above, the present application contemplates a variety of modifications to the process depicted in FIG. 1. For example, in another embodiment, the iron concentration in cleaner concentrate fraction 82 is further increased by treatment through further low intensity magnetic separation phases and wet fine screen (not shown), both of which unit processes reject additional particles with unattractively high concentrations of silica and low concentrations of iron. This embodiment contemplates the addition of a third cleaner magnetic separation step, followed by wet fine screening to send over-sized particles, such as, for example, particles larger than about 48 mesh or 250 microns, to the tailings reject flow stream and sending the flow stream of particles passing the screen, such as, for example, particles smaller than 48 mesh or 250 microns, to desliming and dewatering steps using hydro-cycloning and/or spiral classification devices as described above. In this embodiment, cleaner concentrate fraction 82 generated by the stage two separation in cleaner wheel 80 is subsequently processed to further increase the concentration of iron in the end product by treatment through either low or high intensity magnetic separation using either a conventional low intensity wet drum separator or a third stage separation using a device similar to device 70 or device 80, with the choice between the two depending on the magnetic susceptibility of the stage two concentrate, i.e., cleaner concentrate fraction 82, and the desired grade and recovery of the system product. The choice thereof can be made by a person of ordinary skill in the art. Following the third stage of magnetic separation cleaning, a wet fine screen device (not shown) can be used to separate the product into size fractions desired by a customer, such as, for example, sinter feed which has no more than 10% by weight passing 150 mesh (105 microns) or pelletizing feed which has at least 90% smaller than 150 mesh (105 microns). Additional possible uses of the undersize material passing the fine screen include as a drilling fluid weighting agent or other weighting agent, and for the chemical manufacture of ferric sulfate water treatment anti-coagulants. The stage two and three magnetic separations and the final wet screening in this embodiment can also be used to reject additional particles with unattractively high concentrations of silica and low concentrations of iron. Following these additional steps, the mineral slurry is pumped to dewatering/desliming steps including one or more hydro-cyclones and/or spiral classifiers as described above.

Another embodiment, which is also particularly useful for processing a mineral assemblage comprising natural ore tailings produced by mining operations on the Mesabi Iron Range of Minnesota, is a variation on the process set forth in FIG. 1, and is described below in the context of the system set forth in FIG. 1. In this embodiment, dredge 10 is omitted, and the mineral assemblage slurry starting material is instead provided as follows. Natural ore tailings are excavated using a back hoe machine or similar excavating machine and hauled, for example, using an off road truck, to a surge pile near processing plant 15. For example, in embodiments in which processing plant 15 is housed within a permanent or mobile building, the surge pile can optionally be positioned within the building. From the surge pile, the natural ore tailings, having its natural moisture content, or perhaps having dried somewhat during the time it remains in the surge pile, are fed into a grizzly screen hopper onto an inclined conveyor belt using, for example, a front end loader or similar machine. The natural ore tailings are then introduced into a slurry box by movement of the material up the inclined belt and dumping the natural ore tailings into a flow stream of process water to form a slurry. In one embodiment, the slurry has a solids content of from about 30% to about 50%.

The slurry prepared as described above is then passed through a primary screen to remove oversize materials, such as, for example, particles and other materials larger than 10 mesh or particles and other materials larger than 30 mesh, which particles and debris are transported to a tramp oversize collection dump truck box. The slurry passing through the primary screen is then introduced into a dewatering cyclone, or optionally two or more dewatering cyclones in parallel. These dewatering cyclones are similar to cyclones 40 and 110 depicted in FIG. 1. The overflow out of the cyclone is passed to the tailings thickener prior to pumping to the final reject tailings basin. The slurry passing from the bottom of the one or more dewatering cyclones, referred to as "underflow," is collected in a slurry storage tank equipped with agitators to maintain the mineral assemblage particles in suspension.

The slurry is then passed to a Desliming Hydroseparator, also referred to as a "desliming tower," which uses teeter water to wash or elutriate upward flow of fine silica materials. In the Desliming Hydroseparator, lower density particles (i.e., particles with high silica content in this embodiment), are floated off to an overflow conduit, and higher density particles (i.e., particles with higher iron oxide content in this embodiment), sink to the bottom of the Deslimer Hydroseparator and are discharged therefrom as underflow. The underflow is then transported to one or more hydro-cycloes operating in parallel to perform a size separation ahead of one or more vibratory screens that also perform a size separation. The overflow from the hydro-cyclones, which includes smaller sized, lower density particles, flows by gravity and pipe work or launders to combine with the undersize product made by the vibratory screens described next. The vibratory wet screen, or optionally a plurality of vibratory wet screens operating in parallel, operates to separate oversize particles, such as, for example, particles larger than 32 mesh or particles larger than 48 mesh, which tend to be high in silica and lower in iron. The oversize particles are conveyed to a collection bunker or storage pile. The oversize particles can be sold as a commodity for use in the manufacture of aggregates, sidewalk ice sanding sane or the like. The undersize fraction passing through the wet screen(s) is then mixed with the cyclone overflow discussed above.

In this embodiment, low intensity magnetic separator 50 is omitted, and the slurry passing the 32 mesh vibratory wet screen, together with the cyclone overflow, is passed into a sump, such as sump 61 depicted in FIG. 1, for subsequent passage to a distributor similar to distributor 65 in FIG. 1 and two high intensity magnetic separation phases as shown in FIG. 1. In this embodiment, cyclone 110 is omitted, and cleaner concentrate fraction 82 collected in cleaner concentrate sump 91 is transported directly to spiral classifier 120.

In another embodiment, the cleaner concentrate 82 is further processed to reduce the silica content therein by subjecting the cleaner concentrate 82 to anionic silica flotation using flotation reagents and flotation cells commonly known and employed in the iron ore industry. Anionic silica flotation can be performed at a variety of locations in the process, such as, for example, after cleaner concentrate 82 is isolated in cleaner concentrate sump 91, but before it is introduced into hydro-cyclone 110; after cleaner concentrate 82 passes through hydro-cyclone 110 for removal of excess water therefrom, but before it passes through classifier 120; after cleaner concentrate 82 passes through classifier 120; or after dewatering and/or desliming steps in embodiments that employ dewatering and/or desliming steps. In this embodiment, the cleaner concentrate 82 can be converted into a lower silica concentrate which is known in the trade as a "super concentrate" or DRI grade concentrate.

The final iron concentrate product produced by the above-described processes can be formed into agglomerates, such as, for example, agglomerates having the form of briquettes, pellets or compacts. These can be formed, for example, using briquetters, pelletizing drums or disks, or presses. The production of agglomerate is contemplated to employ a binder that may include hydrated lime otherwise known as calcium hydroxide, calcined lime (CaO) otherwise known as active lime, the same forms of lime as aforementioned except rather than being made from limestone only, those made from either dolomite or from blends of dolomite and limestone; bentonite, and organic binders including organic polymers, wheat starch, gluten, corn starch, or blends thereof. These agglomerates facilitate the shipment and handling of the product and allow it to be easily shipped to distant customers and used by a wider variety of iron making customer facilities.

The transport of a slurry between unit process steps described above can be achieved by gravity flow, by pumping or by a combination of gravity flow and pumping with the ratio of each determined by the physical arrangement of the equipment. For example, with reference to the process depicted in FIG. 1, in one embodiment the respective treatment devices, i.e., wet screen device 20, hydro-cyclone 40, magnetic separation devices 70, cleaner wheel 80, hydro-cyclone 110 and classifier 120, are arranged in stacked form, for example, using vertical structural steel and concrete frames. In this embodiment, transport of a slurry from one device to another can be achieved using gravity flow. In another embodiment, the respective treatment devices are positioned in a flat arrangement, which minimizes the need for concrete and structural steel. In this embodiment, a slurry is transported from one device to another primarily using pumps, such as, for example, pumps 30, 60, 100, 105 and 90 in FIG. 1, and rely less on gravity flow. It is understood by a person of ordinary skill in the art that a system can include a variety of physical arrangements to minimize costs to move slurry from one unit step of the process to the next, depending upon the available resources and the physical environment in which the system is to be assembled.

Figure 2A:
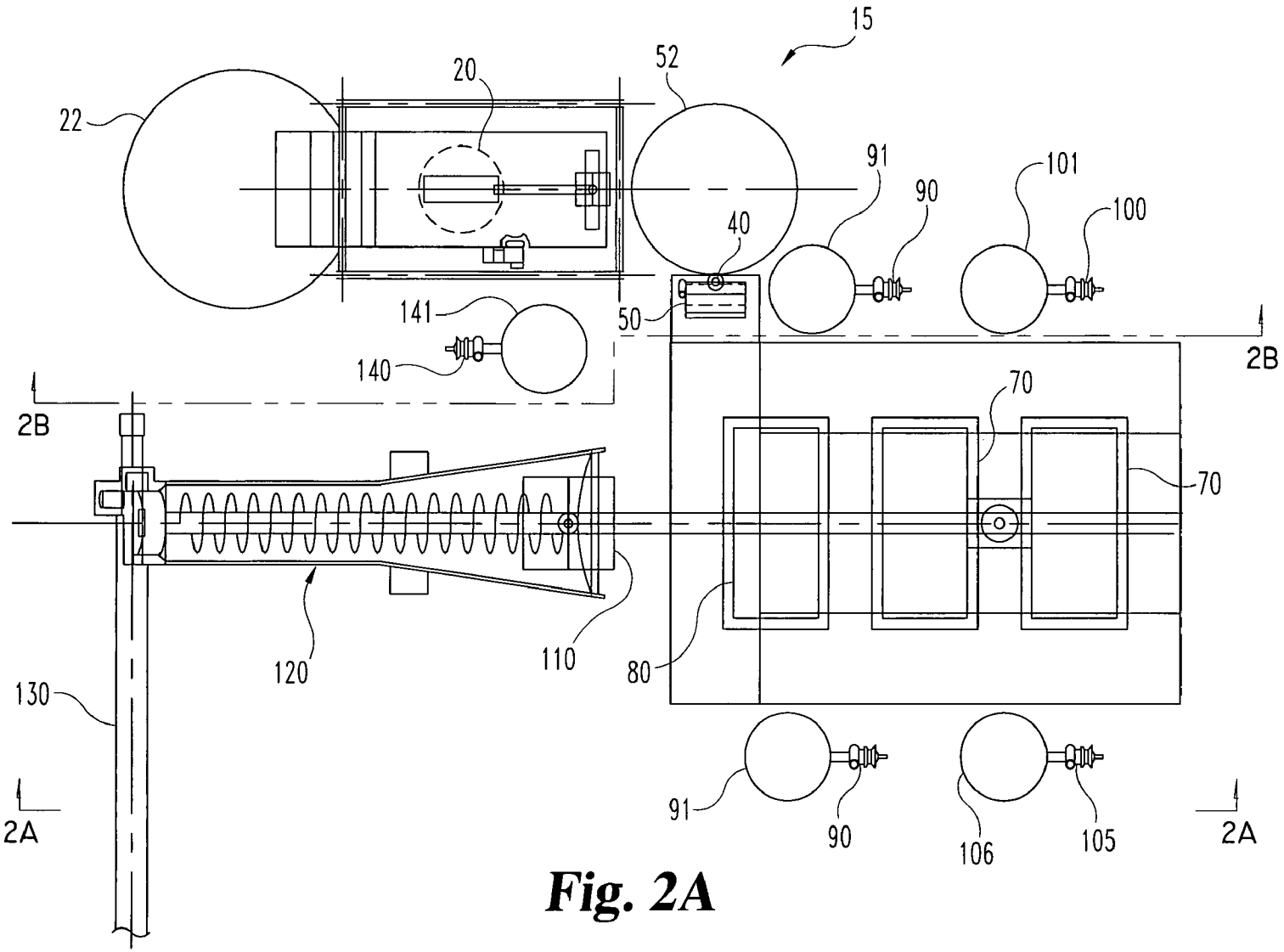
FIG. 2A is a plan view of a treatment system embodiment of the present application.
Figure 2B:
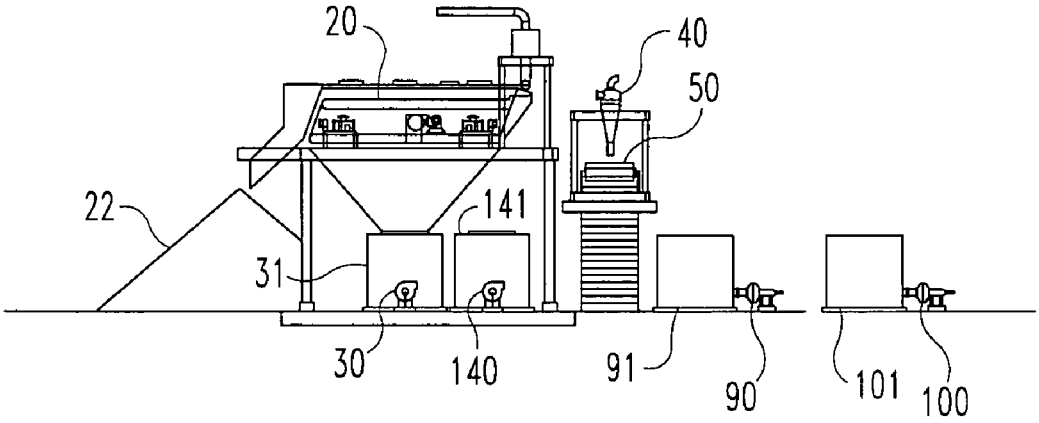
FIG. 2B is an elevational section view of a portion of the system depicted in FIG. 2A.
Figure 2C:
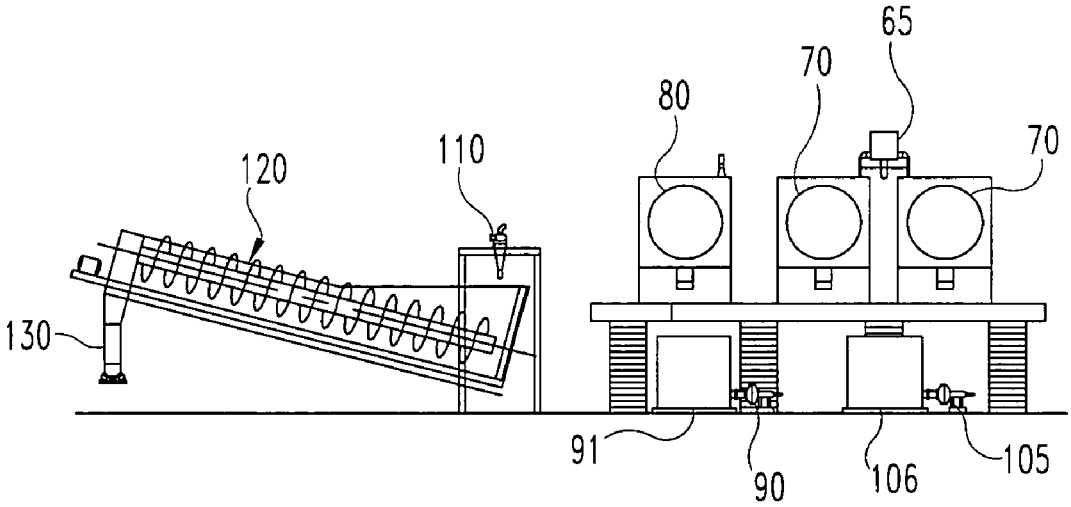
FIG. 2C is another elevational section view of a portion of the system depicted in FIG. 2A.

One example of a suitable layout is depicted in FIGS. 2A-2C, in which FIG. 2A is a top plan view of system 115, FIG. 2B is a sectional elevation view of system 115 and FIG. 2C is a side elevation view of system 115. As seen in FIGS. 2A-2C, system 115 utilizes a combination of gravity flow and pumping to achieve movement of slurries through the treatment process. For example, wet screen 20 is positioned at generally the same elevation as hydro-cyclone 40, and therefore a pump (i.e., pump 30) is required to move cleaned tailings slurry 24 from wet screen 20 to hydro-cyclone 40. Similarly, because magnetic separators 70 are positioned at generally the same elevation as cleaner wheel 80, a pump (i.e., pump 105) is required to move rougher concentrate fraction 74 from rougher concentrate sump 106 to cleaner wheel 80. However, it is further seen that hydro-cyclone 40 is positioned above magnetic separator 50, and thus the slurry exiting hydro-cyclone 50 is transported by gravity flow to magnetic separator 50. Similarly, hydro-cyclone 110 is positioned above classifier 120, and thus the slurry exiting hydro-cyclone 110 is transported by gravity flow to classifier.

System 115 is depicted in FIGS. 2A-2C only as one non-limiting example of how the devices described herein can be positioned and arranged to carry out the methods and processes described herein. A wide variety alternative arrangements can be employed to practice the methods and processes described herein as would occur to person of ordinary skill in the art.

In yet another embodiment, the mineral assemblage is a mineral assemblage obtained by conventional mining methods rather than a mineral assemblage obtained by hydraulic dredge mining. In this embodiment, excavators, such as backhoes, electric shovels, diesel powered shovels, front end loaders, dozers and haul trucks or scrapers or combinations thereof can be employed to deliver the solid tailing product in its natural moisture state to a slurrifying device such as an elutriation scrubber that uses water jets and agitators to break up clumps of tailings and puts the particles into a water suspension slurry suitable for treatment by the methods and processes described herein, which include one or more of wet screening, hydro-cycloning, low intensity magnetic separation, multiple stages high intensity separation, additional low intensity cleaner separation, wet screening, hydro-cycloning, spiral classifying, vacuum dewatering, thermal drying, microwave drying, bagging, stockpiling and shipment, with intermediate transport of the slurry by either gravity flow or pumping through conduits. In yet another embodiment, the mineral assemblage comprises stockpiled iron formation rock that is first reduced in size by crushing and grinding. For example, in one embodiment, iron formation rock is reduced in size to a maximum particle size per the long dimension of less than 1000 microns (U.S. Sieve Size No. 18 or Tyler Equivalent 16 Mesh) prior to processing as described herein.

In still another embodiment, the mineral assemblage comprises virgin or un-mined iron formation rock that is either not selected or deemed unsuited for processing by conventional low intensity separation based "taconite" processing plants due to relatively low concentrations of magnetite mineral in the iron formation. These hematitic or oxidized iron formations, as they are referred to in the trade, typically must be exposed by removal of glacial overburden, dirt and/or rock by an operation known as stripping, then drilled, blasted, and excavated all of which can be done by conventional and well know means and methods. After conventional size reduction including multiple stages of crushing and grinding, for example to a maximum particle size per the long dimension of less than 1000 microns (U.S. Sieve Size No. 18 or Tyler Equivalent 16 Mesh), the resulting mineral assemblage can be put into a slurry form for processing as described herein.

In another aspect, the present application also provides a unique magnetic separation device, referred to herein as a MagWheel™ device, a MagWheel™ separator or the like, for use in the above-described methods and processes as one or more of magnetic separators 70 and/or cleaner wheel 80. The present application also contemplates that the MagWheel™ device can be used in a wide variety of other magnetic separation processes as would occur to a person of ordinary skill in the art. The MagWheel™ device is a high intensity separator that is effective for recovering weakly magnetic particles from a mixture of weakly magnetic and non-magnetic particles, and has the general design of the devices described in U.S. Pat. Nos. 3,947,349; 4,046,680 and 4,874,508 to Fritz, each of which is incorporated by reference herein in its entirety. Generally, the device comprises a large rotatable drum-shaped set of connected, generally parallel spaced apart hollow rings that rotate vertically around a common horizontal axis, and through which a particulate material to be separated is directed. Each hollow ring contains a matrix material that attracts and at least partially retains magnetically susceptible particles in the slurry when it passes through the matrix in a magnetic field. As the drum is rotated, the hollow rings are concurrently rotated through a 360° arc. Through a portion of the arc of rotation, the matrix material in each ring is passed through an applied magnetic field. During this portion of arc movement, magnetically susceptible or magnetic materials within the mixture become entrapped within the matrix material. The non-magnetic materials, however, are unaffected by the magnetic field and are free to move and pass through the matrix even within the magnetic field. The weakly magnetic particles remain associated with the matrix while it is in the magnetic field, but can be released from the matrix material after the matrix material passes beyond the magnetic field. Due to the different behavior of the respective magnetic and non-magnetic particles with respect to the matrix material while it resides in the magnetic field, separation of the particles can be achieved.

In typical operation of the magnetic separator, a particulate mixture is directed into each hollow ring at a position immediately preceding or within the applied magnetic field relative to the rotation of the ring through the magnetic field. Once the mixture is introduced into the hollow ring, and the ring and matrix is passed into the magnetic field, the magnetic components begin to become attached to and entrapped within the matrix residing within the ring. Non-magnetic particles, however, pass through the matrix. Continued rotation of the ring brings the matrix material and entrapped magnetic particles beyond the magnetic field, and the magnetic particles are then released from the matrix and washed out of the ring. Separate collectors can be positioned and used to receive the magnetic particles and non-magnetic particles separately. Circular construction of the individual rings permits efficient operation as a continuous, rather than a batch, system.

In the magnetic separators described in the '349, '680 and '508 patents, the matrix material positioned within the rings comprises, referred to therein as "separator elements," is made from standard carbon steel screening, or steel mesh, that is folded upon itself in a number of plys that, when well compacted, forms a block of foraminous or reticulated material that fits tightly within the rings. In the devices described in the '349 and '680 patents, the mixture to be separated is fed through each ring from the outside of the drum device, near the top of the drum, toward the center of the drum. That is, generally, separation occurs as the mixture is directed through the mesh from an outer periphery of the rings through to a location in the center of the drum, where it is collected and channeled out of the drum through an end of the drum. Conversely, in the device described in the '508 patent, the mixture is fed into an end of the drum and passes through the rings from the inside of the drum, or an inside edge of each ring, at a location near the bottom of the drum, toward the outside of the drum, where it is collected.

The present application provides in one embodiment, a magnetic separator having the general drum-shaped arrangement as described above, and further described in the '349, '680 and '508 patents, the disclosures of which are incorporated by reference herein, but having unique material flow paths and magnetic field arrangements. Specifically, with reference to the embodiment shown schematically in the section view depicted in FIG. 3, an orientation is shown in which hollow ring 270 is configured to rotate clockwise in the direction shown by arrows 275. As the ring rotates, a mixture of magnetic and non-magnetic particles, i.e., a mineral assemblage, is fed into ring 270, and into contact with the matrix material positioned therein (not shown), from feed conduit 210 at a position immediately adjacent to an applied magnetic field generated by permanent magnets 220. In one embodiment, the matrix used to amplify the magnetic field produced by the permanent magnets used in the MagWheel™ is composed of a wire mesh folded with a prescribed number of pleats and openings per unit area. In one embodiment, the wire mesh is folded with at least two and not more than six pleats and includes at least four but not more than sixteen openings per square inch. As ring 270 rotates in the clockwise direction, the mineral assemblage fed into ring 270 passes through the magnetic field, and magnetic particles remain positioned in ring 270 as a result of magnetic attraction to the matrix, as discussed above. In contrast, non-magnetic particles pass through ring 270 and into flowpath 230. As ring 270 rotates beyond the magnetic field in the clockwise direction near the top of the drum, the attraction of the magnetic particles to the matrix no longer exists, and the magnetic particles fall into flowpath 240. The magnetic particles can then be passed from the separator by passage of flowpath 240 through an end of drum 200. As will be appreciated by a person of ordinary skill in the art, passage of the magnetic particles from ring 270 into flowpath 240 can be assisted by spraying additional water through ring 270 from a location above the drum generally opposite flowpath 240. In theory, after ring 270 moves from the region adjacent flowpath 240, no portion of the mineral assemblage remains in ring 270.

Flowpath 230, which is positioned inside drum 200 to receive a non-magnetic fraction of the mineral assemblage, i.e., the portion of the slurry that passed through ring 270 while it was positioned within the magnetic field generated by magnets 220, is further configured to feed the non-magnetic fraction from the inside of drum 200 into ring 270 at a second location at or immediately adjacent to a second magnetic field generated by magnets 225, which are positioned generally opposite magnets 220 relative to drum 200. As ring 270 rotates in the clockwise direction, the non-magnetic fraction positioned in ring 270 within the magnetic field generated by magnets 225 passes through the magnetic field, and magnetic particles remain positioned in ring 270 as a result of magnetic attraction to the matrix, as discussed above. In contrast, non-magnetic particles pass through ring 270 and into final tailings flowpath 250. As ring 270 rotates beyond the magnetic field in the clockwise direction near the bottom of drum 200, the attraction of the magnetic particles to the matrix no longer exists, and the magnetic particles fall into magnetic concentrate flowpath 260.

Figure 3:
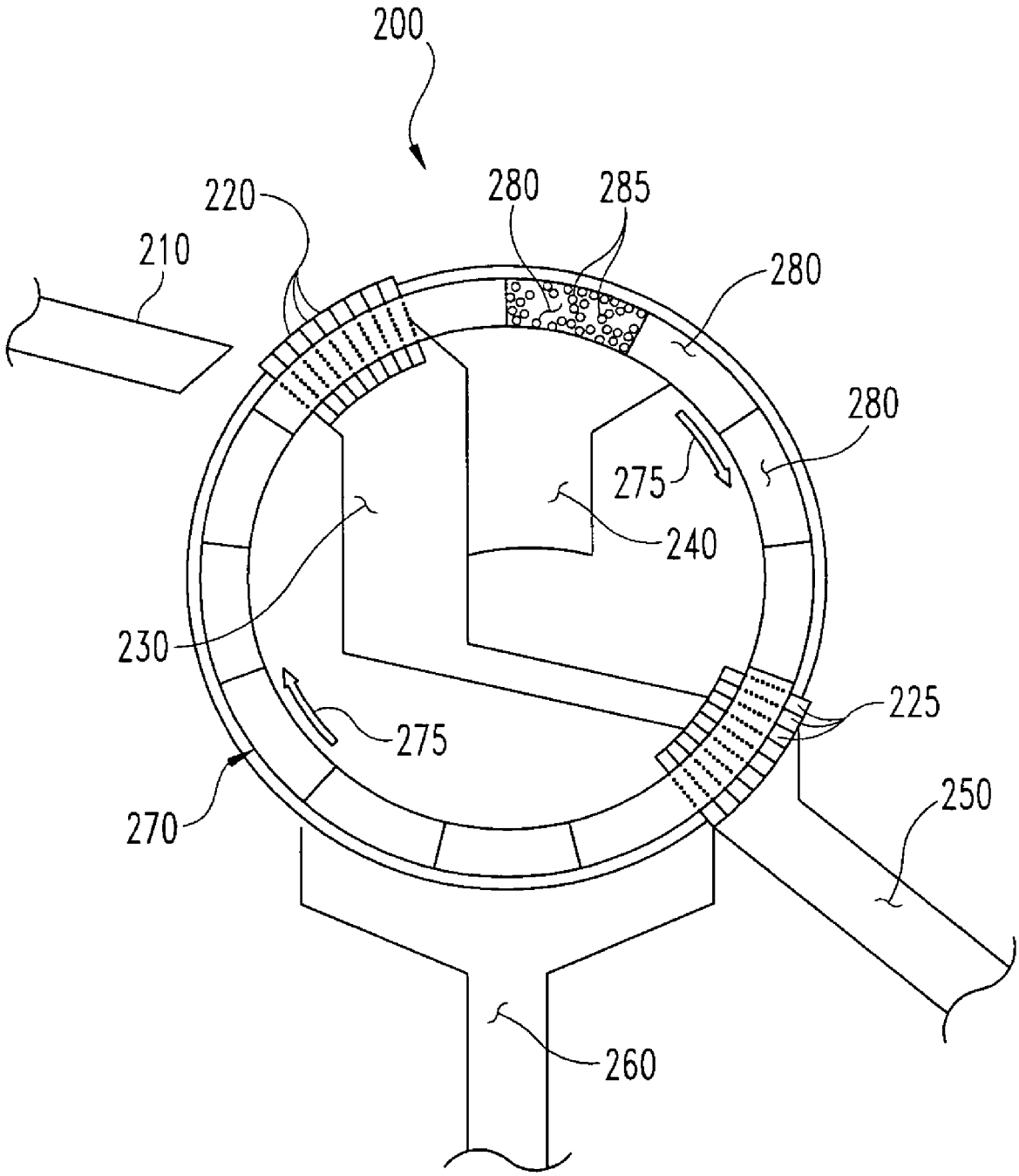
FIG. 3 is a schematic cross section view of a MagWheel™ embodiment including a plurality of distinct features described in the present specification.

As is readily apparent from the above, the embodiment depicted in FIG. 3 as described above passes particles through ring 270, and thus through the matrix material positioned therein, two different times within two different applied magnetic fields before reaching final tailings flowpath 250, and therefore being considered tailings materials. In addition, due to the positioning of feed conduit 210 and flowpath 230, fluids intermittently pass through ring 270, and the matrix material positioned therein, in alternating directions as ring 270 rotates. Thus, any oversized material that may happen to be fed into contact with ring 270 from feed conduit 210 will likely remain on the outside surface of ring 270, and then be washed from the surface as the slurry passes from flowpath 230 and through ring 270 in the opposite direction at the location of the second magnetic field generated by magnets 225. Flushing can also be assisted with additional water sprayers positioned on the interior or exterior of drum 200.

In another embodiment, the MagWheel™ separator employs flexible side walls for each individual ring of the separator, as described in the '508 patent, such that the wire mesh matrix is allowed to expand when it is outside of the magnetic field thus facilitating the release of the particles collected and captured by the matrix. This feature addresses a problem of high intensity magnetic separators in the prior art which are plagued by plugging with mineral particles which ultimately render the separator inoperable until taken out of production for cleaning by laborious and costly methods.

In yet another embodiment, the MagWheel™ separator includes a matrix that comprises mild steel plates with a machined profile in a zig/zag or saw-tooth profile together with precise spacers to establish a uniform gap between parallel sheets of the steel plates. Such plates having zig/zag or saw-tooth profile are located in ring 270 around and occupying the entire outer circumference of each ring of the separator wheel to provide a matrix with a high magnetic susceptibility to function as a magnetic field amplifier and provide multitude of collection sites at the peak field intensity points of the matrix.

In still another embodiment, the MagWheel™ separator includes a matrix that comprises steel plates with punched holes or perforations together with precise spacers to establish the gap between parallel sheets of the perforated mild steel plate. Such plates having punched holes or perforations are located in ring 270 around and occupying the entire outer circumference of each ring of the separator wheel to provide a matrix with a high magnetic susceptibility to function as a magnetic field amplifier and provide multitude of collection sites at the peak field intensity points of the matrix.

In another embodiment, a magnetic separator is provided that has the general drum-shaped arrangement as described above, and further described in the '349, '680 and '508 patents, but having hollow rings that define discreet compartments 280 positioned around at least one ring, and preferably each ring, of the separator drum, or wheel, as depicted in FIG. 3. In one embodiment, the discreet compartments 280 occupy the entire circumference of ring 270. Compartments 280 are configured to contain a prescribed quantity per compartment of discreet objects 285, such as, for example, steel shot, iron balls or spheres, with high magnetic susceptibility. Objects 285 function as magnetic field amplifiers, and can be used in place of the wire mesh matrix described in the '349, '680 and '508 patents. Moreover, while it is not intended that the present invention be limited by an theory whereby it achieves any result, it is believed that objects 285, when passing through the magnetic fields generated by permanent magnets 220 and 225, become packed into fixed positions in compartment 280, such as, for example, in a relatively horizontal layer as a result of the forces of gravity and of the applied magnetic fields, which packing provides an effective matrix for separating magnetic particles from non-magnetic particles as a slurry passes through compartments 280. After a given compartment 280 passes out of a magnetic field, objects 285 are released from the packed orientation and are free to tumble and move in compartment 280 as ring 270 rotates. As a result, the use of objects 285 as described provides an excellent matrix for separating magnetic particles having excellent grade, while also achieving excellent recovery and throughput together with excellent self-cleaning characteristics due to the tumbling action of objects 285 as a given compartment 280 rotates out of a magnetic field. As will be appreciated by a person skilled in the art, when objects 285 are included in compartments 280 any apertures allowing flow of a slurry into and out of ring 270 should be structured to prevent passage of objects 285 out of compartments 280 as the slurry passes therethrough. For example, in one embodiment, apertures provided in the walls of ring 270 (not shown) are covered by a layer of screen cloth (not shown) defining openings smaller than the size of objects 285, and thereby operative to hold objects 285 in compartments 280 as the slurry passes through compartments 280.

In one embodiment, the matrix used to amplify the magnetic field produced by the permanent magnets used in the MagWheel™ is composed of a mixture of steel or iron shot (spheres) such as the shot used in shotgun shells or similar collections of iron or steel spheres or balls. In one embodiment, combinations of shot of different sizes are included in compartments 280. For example, in one embodiment a combination of larger size shot, such as, for example, #00, #0, #BB, #1, #2 or #3 shot together with a smaller size shot, such as, for example, #4, #5, #6, #7 or #8 shot is included in compartments 280. In one embodiment, the combination includes #2 or #3 shot together in a 1:1 ratio with a smaller size shot like a #4 or #5 shot. In testing described in the Examples below, the combination of larger balls or shot, such as, for example, a #2 shot mixed 50/50 with a #5 shot, gave excellent recovery plus excellent flow rates and still offered the benefits of a self-cleaning matrix as the wheel of the separator turns and flush water hits the matrix. In another embodiment, the combination includes a large-size shot, such as, for example, a #2 shot together in a 1:2 ratio with a smaller size shot, such as, for example, a #5 shot. It is to be appreciated, however, that a variety of sizes and ratios can be employed, and variation in the sizes and ratios can be useful to achieve an optimal combination of grade and recovery depending upon the actual characteristics of a slurry being treated, such as, for example, the mineral grain size, liberation degree, hematite content and nonmagnetic content.

In another aspect of the present application, a method or process for treating a mineral assemblage as described above utilizes a magnetic separator of the type described in the '349, '680 and '508 patents, or a MagWheel™ separator as described herein, for one or more of magnetic separators 70 and/or cleaner wheel 80, and further comprises adding a finely divided magnetite material to the slurry to be treated by the magnetic separator in a prescribed ratio to the solids in the slurry. In one embodiment, the ratio of magnetite material to solids in the slurry is a ratio of between 1% by weight and 10% by weight. The magnetite material operates in the slurry as additional collection points in the matrix. Thus, by incorporating magnetite material into the slurry, the effective frequency and number of collection points in the matrix, used to amplify the magnetic field produced by the permanent magnets, is increased, causing the recovery and grade of the resultant iron concentrate to be increased compared to that achievable without the use of the magnetite additive. In this embodiment, the magnetite adheres to the matrix regardless of the form of matrix included in ring 270 and can be effectively recycled and reused by removal of the magnetite from the flow stream by separation of the magnetite from weakly magnetic particles in the slurry using one or more low intensity wet drum magnetic separators. Thereafter, the magnetic magnetite particles can be recycled back to the new feed going to the MagWheel™, if desired, for reuse as described above. This form of the invention can be employed regardless of the type of matrix that is employed in the MagWheel™ separator including various sizes of steel or iron shot or mixtures thereof, wire mesh of various pleat thicknesses and mesh opening sizes and frequencies, machined parallel steel plates, punch plate, or "zig-zag" plate arranged in parallel sheets, to name a few of the types of magnetic field amplifying matrix types contemplated by the present application.

As mentioned above, the treatment processes described herein can also be used to treat mineral assemblages that include gold. For example, mineral assemblages including gold in leaf form, magnetite in fine grain form, and varying amounts non-magnetic materials, such as, for example, silica, silicates, olivines, feldspars and carbonates, can be usefully processed in accordance with the present disclosure to concentrate and recover the gold. In one embodiment, a mineral assemblage including gold is processed through one or more stages of high intensity magnetic separators, such as, for example, the MagWheel™ separators described herein, wherein the magnets generating the magnetic fields are positioned relatively close to the point where flow path 230 is split from flowpath 240 and flowpath 250 is split from flowpath 260, respectively, referred to herein as "split points," and wherein slurry feed conduit 210 and outlet of flowpath 230 are positioned adjacent and relatively close to the applied magnetic fields generated by magnets 220, 225, respectively at points close to the respective split points. This orientation provides for improved separation of the non-magnetic materials in the mineral assemblage from gold. In one embodiment, the non-magnetic stream exiting device 200 through flowpath 250 is passed through one or more additional stages of high intensity magnetic separation to pick up any missed gold. In another embodiment, the magnetic fraction exiting device 200 through flowpath 260 is also passed through one or more additional stages of high intensity magnetic separation to reject any misplaced non-magnetic materials. The final concentrate collected from flowpath 260 of the final high intensity magnetic separation phase will contain a high proportion of the original magnetite with a high proportion of the leaf gold associated with the magnetite due to the application of the high strength magnetic field. The gold can then be separated from the magnetite either by processing the mixture through a low intensity magnetic separation, such as, for example, a conventional low intensity wet drum magnetic separator with permanent magnets from about 600 gauss to about 1500 gauss, with no use of an amplifying matrix, or use of a MagWheel™ separator set up to operate with lower effective magnetic field strength by use of magnets of lower strength; or by processing the mixture through a high intensity MagWheel™ separator modified such that the slurry is introduced into the applied magnetic fields at a position further away from the magnetizing zones or split points. This process phase separates the magnetite to the magnetic flowstream and the gold to the nonmagnetic, or tailings, flowstream. The fraction containing the gold can then be further processed, if desired, by conventional chemical or mechanical means such as, for example, screening, jig tables, sluice or wash tables, cyclones or pans to further concentrate the gold. The magnetite-containing fraction can be further processed, if desired, to recover other precious metals such as palladium and platinum if present in association with the magnetite.

Mineral assemblages that can be treated using the processes described above include, for example virgin alluvial black sand deposits in Alaska and gold tailings from former gold processing operations in Alaska. Of course the process can also be applied to other alluvial gold deposits or gold tailings around the world.

Reference will now be made to the following examples of laboratory work that has been performed in connection with the subject matter of this application. It is understood that no limitation to the scope of the invention is intended thereby. The examples of tests conducted are provided solely to promote a full understanding of the concepts embodied in the present application.

Examples of Laboratory Testing

Experimental tests have been conducted with regard to the treatment of waste mineral assemblages including iron in the form of iron oxides. A bulk sample of more than ten tons was collected from one of the tailings basins in Northern Minnesota left behind by mining and mineral processing of natural iron ore in the 1960s. The tailing material was excavated by a back hoe excavator and hauled to a mineral processing laboratory near the subject tailings basin. In the lab both a pilot scale system (the "Pilot Plant") capable of treating up to 30 kg per minute of tailing feed material and a bench scale system (the "Bench Tester") capable of treating up to 400 gram batches of tailing feed material have been set up and used.

The Pilot Plant has been used to run more than six three hour continuous test runs to process the tailing feed material that averages approximately 33% total iron dry basis. The Pilot Plant consists of hand feeding of feed material to a slurrifying rotating ball mill loaded with nominal amount of ball charge to break up the clumps of feed material and effectively slurrify the feed into water based slurry of about 20% to 30% solids by weight. The feed slurry leaves the ball mill and passes through a wet "tramp" screen to remove particles and debris large than a No. 10 Sieve (9 Mesh) or 2 millimeters which oversize is a reject material. The slurry free of plus 2 mm debris is then pumped to a low intensity magnetic separator equipped with permanent magnets of about 1000 gauss strength set up in a conventional wet concurrent material flow drum separator configuration similar to low intensity drum magnetic separator units produced commercially by Eriez Magnetics of Erie Pa. The magnetic material recovered is magnetite, mag-hemite with minor amounts of heavy media reagent Ferrosilicon that was used in the heavy media plant that generated the natural ore tailings material being used as feed stock for this pilot testing. The non-magnetics, which are actually weakly magnetic but not strong enough in magnetic susceptibility to be picked up the low intensity separator, are pumped to a Derrick™ wet screen to remove oversize particles that otherwise would plug the matrix of the MagWheel™ separator. The Derrick™ wet screen is equipped with a screen cloth with various screen cloths the most advantageous one for this feed material was found to be 28 mesh. Screen cloths with 60 mesh, 20 mesh, 25 mesh, 35 mesh and 48 mesh were tested and it was found that not smaller than 25 mesh worked best to avoid excessive plugging of the matrix if wire cloth matrix was used while minimizing the loss of the element sought (iron in this example) to be recovered in the oversize material. In embodiments utilizing steel shot as the matrix material, as described above, no screening step to remove plus 25 mesh particles was necessary. If a finer cloth is used such as a 60 mesh cloth or finer, then more oversize is rejected and the iron losses in this material become unacceptable due to the high cost of the iron losses. After the Derrick™ wet screen the undersize particle slurry flows by gravity to the stage one MagWheel™ high intensity magnetic separator equipped with permanent magnets and a matrix to amplify the magnetic field flux density to as high as 50,000 gauss. A wide variety of matrix materials were tested using the Bench Tester. Based on these test results using the Bench Tester, the Pilot Plant was equipped with a wire cloth of optimal design for this particular feed material.

A set of tests were also conducted using this same feed material on the Bench Tester and various matrix materials. One of the unexpected discoveries was that steel shot of various sizes worked well as a matrix material and produced in many cases superior iron recovery and grade to other matrix designs tested. Mixtures of various steel shot sizes were also tested and optimal performing mixes were identified as well. The use of steel shot as a matrix material showed a number of advantages in addition to its superior metallurgical performance as measured by product grade and recovery. It also showed the advantageous feature of not plugging with particles because the shot dislodges and moves around as the wheel rotates and can be effectively flushed of trapped particles by wash water as the MagWheel™ rotated and the shot was confined such that there is room for the shot to move yet not so much room that the shot is out of a uniform horizontal position forming a relatively uniform horizontal layer of shot as it enters the magnetic field and thus becomes locked into position by the magnetic field. Combinations of shot sizes and test of various shot sizes were done and it was found that for any given feed material an optimal combination of larger shot like #2 or #3 shot together in a 50/50 ratio with a finer shot like a #4 or #5 shot gave an excellent recovery with an excellent flow rate through the matrix material. The flow rate is important because this variable determines the productive capacity of the MagWheel™ for a given size of separator. This balance of larger balls or shot like a #2 shot mixed 50/50 with a #5 shot gave excellent recovery plus excellent flow rates and still offered the benefits of a self-cleaning matrix as the wheel of the separator turns and flush water hits the matrix. The ratio of small balls to larger balls identified above is not intended to be restrictive, but rather is provided as an example. The key discovery herewith is that finer ball sizes as a collection used as a magnetic field amplifier produce a progressively higher rate of iron particle recovery due to the increased number of amplification points made by the contact points between individual iron or steel spheres. The present application further contemplates that a balance can be obtained between recovery of the element sought such as iron versus the productive rate determined by the flow rate of the slurry through the shot matrix mixture by selecting the shot sizes and ratios of shot sizes in the mixture of spheres employed such that an optimal balance of recovery and throughput or productivity of the separator and the overall circuit is achieved. The selection of the appropriate mixture of various steel or iron shots, considering the tradeoff of recovery and production rate, can readily be determined by someone skilled in the prior art of mineral processing in view of the present disclosure. To the extent that smaller shot such as for example #4, #5, #6, #7 or #8 shot, is selected then elemental recovery will tend to be maximized while if larger diameter shot is used such as for example, #00, #0, #BB, #1, #2 or #3 shot, then the flow rate or mass flow rate through the shot matrix will tend to be increased compared to smaller diameter shot. The appropriate size will depend on the particle size, mineralogy and magnetic susceptibility of the mineral mixture to be used but by conducting bench tests using the methods described herein one skilled in the prior art of mineral processing can readily determine the optimal combination of shot sizes for a given mineral assemblage to be treated.

Additional tests of the Pilot Plant at various feed rates established the productive capacity of the systems, methods and processes together with other critical variables such as magnet spacing, magnet types and strengths, wheel speeds, screen cloth sizes, percent solids of slurry, recovery of each unit process, mass flow rates through the steps of the process and chemistry and size characteristics of final and intermediate processes.

More than 100 tests have been conducted using the Bench Tester on various tailing feedstock, size reduced oxidized hematitic ores, gold bearing assemblages, and feed stocks of a wide variety of compositions. The systems, methods and process described in the present application are based on this considerable data base of test results some of which have been described in general terms above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for separating a mineral assemblage slurry into a magnetic particle fraction and a non-magnetic particle fraction, comprising:

providing a high intensity magnetic separation device comprising a drum-shaped set of connected and spaced apart hollow rings rotating around a common horizontal axis, each hollow ring defining openings through inner and outer surfaces thereof and containing a matrix material therein, whereby said set of rings is configured to allow passage of a plurality of separate inwardly moving fluid streams through said outer openings into said hollow rings, in contact with said matrix material contained in said rings, and through said inner openings, and to allow passage of an outwardly moving fluid stream through said inner openings, said matrix material, and said outer openings; said device further comprising a first set of permanent magnets positioned to apply a first magnetic field across said rings at a first position in an upper quadrant of said rings where the rotation of said rings approaches the top-most point of rotation, and a second set of permanent magnets positioned to apply a second magnetic field across said rings at a second position in the lower quadrant of said rings where the rotation of said rings approaches the bottom-most point of rotation;

feeding the slurry to an outer surface of said set of rings, and into said rings through said outer openings, at a position where said matrix is positioned in said first magnetic field;

passing a first non-magnetic particle fraction through the matrix while the matrix is in the first magnetic field and into a first non-magnetic flowpath;

flushing magnetic particles that adhere to the matrix in the first magnetic field with water after the matrix rotates out of the first magnetic field, to pass said magnetic particles into a first magnetic flowpath separate and distinct from the first non-magnetic flowpath to provide a first magnetic particle fraction;

feeding the first non-magnetic particle fraction to an inner surface of said set of rings, and into said rings through said inner openings, at a position where said matrix is positioned in said second magnetic field;

passing a second non-magnetic particle fraction through the matrix while the matrix is in the second magnetic field and into a second non-magnetic flowpath; and flushing magnetic particles that adhere to the matrix in the second magnetic field with water after the matrix rotates out of the second magnetic field, to pass said magnetic particles into a second magnetic flowpath separate and distinct from the second non-magnetic flowpath to provide a second magnetic particle fraction;

wherein at least one of said hollow rings is divided into a plurality of arc-shaped compartments; and wherein each of said plurality of compartments contains a plurality of discreet magnetically susceptible objects.

2. The method of claim 1, further comprising combining the first magnetic particle fraction and the second magnetic particle fraction to provide a concentrate fraction and passing the concentrate fraction through a second high intensity magnetic separator.

3. The method of claim 1, further comprising combining the first magnetic particle fraction and the second magnetic particle fraction to provide a concentrate fraction and passing the concentrate fraction back through the high intensity magnetic separation device.

4. The method of claim 1 wherein substantially all of the particles in the mineral assemblage are smaller than 700 microns.

5. The method of claim 1, further comprising combining the first magnetic particle fraction and the second magnetic particle fraction to provide a concentrate fraction and passing the concentrate fraction through a de-watering device.

6. The method of claim 5 wherein the dewatering device is selected from the group consisting of a hydro-cyclone, a spiral classifier, a vibratory screen/conveyor that removes excess water and slimes suspended in the excess water, a thickener/clarifier, a filter press, a drum vacuum filter, a disk vacuum filter, a dryer, and a bulk storage pile allowing gravity draining of entrained water.

7. The method of claim 1, wherein the mineral assemblage slurry comprise non-magnetic particles and weakly magnetic particles.

8. The method of claim 7, wherein the non-magnetic particles comprise silica and the weakly magnetic particles comprise iron minerals other than magnetite.

9. The method of claim 1, wherein the mixture of particles comprise non-magnetic particles of silica, strongly magnetic particles of magnetite, and weakly magnetic particles of hematite.

10. The method of claim 1, wherein the magnetic particles comprise iron oxides.

11. The method of claim 1, wherein the magnetic particles comprises hematite and magnetite.

12. The method of claim 11, wherein at least some of the magnetite remains with the rotating matrix and acts to create additional collection sites and increases the amplification of the magnetic field compared to the absence of magnetite.

13. The method of claim 1, wherein at least a plurality of the discrete objects comprise a member selected from the group consisting of steel shot and iron shot.

14. The method of claim 1, wherein the matrix comprises wire mesh having significant magnetic susceptibility.

15. The method of claim 1, wherein the mineral assemblage slurry comprises iron ore tailings generated by a mineral processing plant.

16. The method of claim 15, wherein the mineral processing plant comprises a plant selected from the group consisting of a natural ore wash plant, a taconite mineral beneficiation plant, and a natural ore heavy media plant.

17. The method of claim 1, wherein the mineral assemblage slurry comprises a member selected from the group consisting of tailings generated by gold mining operations, alluvial deposits containing gold, finely divided particles of minerals containing gold, finely divided particles of minerals containing platinum, and finely divided particles of minerals containing palladium.

18. A method for separating a mineral assemblage slurry into a magnetic particle fraction and a non-magnetic particle fraction, comprising:

providing a high intensity magnetic separation device comprising a drum-shaped set of connected and spaced apart hollow rings rotating around a common horizontal axis, each hollow ring defining openings through inner and outer surfaces thereof and containing a matrix material therein, whereby said set of rings is configured to allow passage of a plurality of separate inwardly moving fluid streams through said outer openings into said hollow rings, in contact with said matrix material contained in said rings, and through said inner openings, and to allow passage of an outwardly moving fluid stream through said inner openings, said matrix material, and said outer openings; said device further comprising a first set of permanent magnets positioned to apply a first magnetic field across said rings at a first position in an upper quadrant of said rings where the rotation of said rings approaches the top-most point of rotation, and a second set of permanent magnets positioned to apply a second magnetic field across said rings at a second position in the lower quadrant of said rings where the rotation of said rings approaches the bottom-most point of rotation;

mixing magnetite particles into the mineral assemblage slurry to provide a feed mixture;

feeding the feed mixture to an outer surface of said set of rings, and into said rings through said outer openings, at a position where said matrix is positioned in said first magnetic field;

passing a first non-magnetic particle fraction through the matrix while the matrix is in the first magnetic field and into a first non-magnetic flowpath;

flushing magnetic particles that adhere to the matrix in the first magnetic field with water after the matrix rotates out of the first magnetic field, to pass said magnetic particles into a first magnetic flowpath separate and distinct from the first non-magnetic flowpath to provide a first magnetic particle fraction;

feeding the first non-magnetic particle fraction to an inner surface of said set of rings, and into said rings through said inner openings, at a position where said matrix is positioned in said second magnetic field;

passing a second non-magnetic particle fraction through the matrix while the matrix is in the second magnetic field and into a second non-magnetic flowpath; and flushing magnetic particles that adhere to the matrix in the second magnetic field with water after the matrix rotates out of the second magnetic field, to pass said magnetic particles into a second magnetic flowpath separate and distinct from the second non-magnetic flowpath to provide a second magnetic particle fraction.

19. A method for separating a mineral assemblage slurry into a magnetic particle fraction and a non-magnetic particle fraction, comprising:

providing a high intensity magnetic separation device comprising a drum-shaped set of connected and spaced apart hollow rings rotating around a common horizontal axis, each hollow ring defining openings through inner and outer surfaces thereof and containing a matrix material therein, whereby said set of rings is configured to allow passage of a plurality of separate inwardly moving fluid streams through said outer openings into said hollow rings, in contact with said matrix material contained in said rings, and through said inner openings, and to allow passage of an outwardly moving fluid stream through said inner openings, said matrix material, and said outer openings; said device further comprising a first set of permanent magnets positioned to apply a first magnetic field across said rings at a first position in an upper quadrant of said rings where the rotation of said rings approaches the top-most point of rotation, and a second set of permanent magnets positioned to apply a second magnetic field across said rings at a second position in the lower quadrant of said rings where the rotation of said rings approaches the bottom-most point of rotation;

mixing magnetite particles into the mineral assemblage slurry to provide a feed mixture;

feeding the feed mixture to an outer surface of said set of rings, and into said rings through said outer openings, at a position where said matrix is positioned in said first magnetic field;

passing a first non-magnetic particle fraction through the matrix while the matrix is in the first magnetic field and into a first non-magnetic flowpath;

flushing magnetic particles that adhere to the matrix in the first magnetic field with water after the matrix rotates out of the first magnetic field, to pass said magnetic particles into a first magnetic flowpath separate and distinct from the first non-magnetic flowpath to provide a first magnetic particle fraction;

feeding the first non-magnetic particle fraction to an inner surface of said set of rings, and into said rings through said inner openings, at a position where said matrix is positioned in said second magnetic field;

passing a second non-magnetic particle fraction through the matrix while the matrix is in the second magnetic field and into a second non-magnetic flowpath; and flushing magnetic particles that adhere to the matrix in the second magnetic field with water after the matrix rotates out of the second magnetic field, to pass said magnetic particles into a second magnetic flowpath separate and distinct from the second non-magnetic flowpath to provide a second magnetic particle fraction;

wherein said feeding the first non-magnetic particle fraction comprises mixing magnetite particles into the first non-magnetic particles to provide a second mixture; and feeding the second mixture to an inner surface of said set of rings, and into said rings through said inner openings, at a position where said matrix is positioned in said second magnetic field.

20. A high intensity magnetic separation device for separating a mineral assemblage slurry into fractions, comprising:

a drum-shaped set of connected and spaced apart hollow rings rotating around a common horizontal axis, each hollow ring defining openings through inner and outer surfaces thereof and containing a matrix material therein, whereby said set of rings is configured to allow passage of an inwardly moving fluid stream through said outer openings, said matrix material, and said inner openings, and to allow passage of an outwardly moving fluid stream through said inner openings, said matrix material, and said outer openings; said device further comprising a first set of permanent magnets positioned to apply a first magnetic field across said rings at a first position in an upper quadrant of said rings where the rotation of said rings approaches the top-most point of rotation, and a second set of permanent magnets positioned to apply a second magnetic field across said rings at a second position in the lower quadrant of said rings where the rotation of said rings approaches the bottom-most point of rotation;

at least one feed conduit for delivering the slurry into said hollow rings within said first magnetic field; and at least two flowpaths at least partially positioned within said drum-shaped set of hollow rings for receiving separated fractions of said slurry after it passes through said rings;

wherein at least one of said hollow rings is divided into a plurality of arc-shaped compartments; and wherein each of said plurality of compartments contains a plurality of discreet magnetically susceptible objects.

21. The method of claim 20, wherein at least a plurality of the discrete objects comprise a member selected from the group consisting of steel shot and iron shot.

* * * * *